US007681781B2

(12) United States Patent
Wisecarver

(10) Patent No.: US 7,681,781 B2
(45) Date of Patent: Mar. 23, 2010

(54) OCTAGONAL BULK BIN WITH SELF-LOCKING GUSSET-FOLD BOTTOM FLAPS

(75) Inventor: Mark A. Wisecarver, Morristown, TN (US)

(73) Assignee: International Paper Company, Memphis, TN (US)

( * ) Notice: Subject to any disclaimer, the term of this patent is extended or adjusted under 35 U.S.C. 154(b) by 704 days.

(21) Appl. No.: 11/512,865

(22) Filed: Aug. 29, 2006

(65) Prior Publication Data

US 2007/0051783 A1 Mar. 8, 2007

Related U.S. Application Data

(60) Provisional application No. 60/712,236, filed on Aug. 29, 2005.

(51) Int. Cl.

| | |
|---|---|
| ***B65D 5/00*** | (2006.01) |
| ***B65D 5/10*** | (2006.01) |
| ***B65D 5/08*** | (2006.01) |
| ***B65D 5/24*** | (2006.01) |
| ***B65D 19/00*** | (2006.01) |

(52) U.S. Cl. ..... 229/109; 229/156; 229/157; 229/920; 229/930; 229/931; 229/184; 229/188; 229/185; 229/137; 206/386

(58) Field of Classification Search ..... 229/109, 229/156, 157, 920, 930, 931, 184, 188, 185, 229/137; 206/386

See application file for complete search history.

(56) References Cited

U.S. PATENT DOCUMENTS

| | | | | |
|---|---|---|---|---|
| 3,261,533 A | | 7/1966 | Repking | |
| 4,428,499 A | | 1/1984 | Nauheimer | |
| 4,480,748 A | * | 11/1984 | Wind | 206/386 |
| 4,702,408 A | | 10/1987 | Powlenko | |
| 5,139,196 A | * | 8/1992 | Fry et al. | 229/157 |
| 5,628,450 A | * | 5/1997 | Cromwell et al. | 229/109 |
| 5,752,648 A | | 5/1998 | Quaintance | |
| 5,816,483 A | * | 10/1998 | Gasper | 229/109 |
| 6,074,331 A | * | 6/2000 | Ruggiere et al. | 493/89 |
| 6,132,349 A | * | 10/2000 | Yokoyama | 493/86 |
| 6,371,363 B1 | | 4/2002 | Franklin et al. | |
| 6,588,651 B2 | | 7/2003 | Quaintance | |
| 6,783,058 B2 | | 8/2004 | Quaintance | |
| 2003/0116615 A1 | | 6/2003 | Hyatt et al. | |

FOREIGN PATENT DOCUMENTS

| | | |
|---|---|---|
| DE | 2818110 | 11/1978 |
| EP | 1544117 | 6/2005 |
| US | 4247021 | 1/1981 |

* cited by examiner

*Primary Examiner*—Gary E Elkins
*Assistant Examiner*—Latrice Byrd
(74) *Attorney, Agent, or Firm*—Thomas W. Barnes, III; Dennis Lambert

(57) ABSTRACT

An octagonal bulk bin has sidewalls, end walls and diagonal corner panels interposed between adjacent sidewalls and end walls. Bottom flaps are foldably joined to a bottom edge of the sidewalls, end walls, and diagonal corner panels, and gusset panels connect adjacent side edges of the bottom flaps, facilitating set up of the bulk bin and spacing flap cuts from the corners of the bin to minimize or eliminate initiation of tears in the vertical corners of the bin. A plastic pallet tray has an upstanding lip around its periphery, shaped and sized to closely receive the bottom end of the octagonal bin to reinforce the bottom end and facilitate handling of the bin.

16 Claims, 9 Drawing Sheets

OCTAGONAL BULK BIN WITH SELF-LOCKING GUSSET-FOLD BOTTOM FLAPS

This application claims the benefit of U.S. provisional patent application Ser. No. 60/712,236, filed Aug. 29, 2005.

BACKGROUND OF THE INVENTION

1. Field of the Invention

This invention relates to bulk bins, and particularly to a self-locking bottom flap construction for octagonal bulk bins.

2. The Prior Art

Bulk bins are used in the industry for storing and shipping numerous products, and typically hold 2,000 pounds or more of the product, including flowable or semi-liquid products such as, e.g., comminuted poultry. When flowable products are to be contained in the bin, a bag normally is placed in the bin for receiving the product. The outward force exerted on the sidewalls by flowable products, in particular, is substantial, and tends to bulge the sidewalls outwardly. The bins are commonly made of corrugated cardboard and comprise a plurality of sidewalls joined together along vertical folds. The bottoms of the bins preferably are closed or partially closed by inwardly folded bottom flaps joined to bottom edges of the side walls along horizontal folds. The flaps are separated from one another by slots or cuts extending from an outer edge of the flaps to a point at or near the intersection of the vertical and horizontal folds. This structure creates a weak point where tearing of the vertical fold can initiate. Tearing of the vertical fold can propagate rapidly upwardly, resulting in bursting of the sidewall and failure of the bin, with consequent loss of the stored product.

At least partially to minimize the outward bulge of the sidewalls, the industry has adopted bulk bins having an octagonal shape, wherein diagonal corner panels are interposed between adjacent edges of the opposed sidewalls and opposed end walls. In conventional octagonal bins the diagonal corner panels are of less width than either the sidewalls or the end walls of the bin, and although the octagonal configuration reduces the width of the sidewalls and/or end walls in a bin having a comparable capacity and size to a corresponding four-sided bin, thus reducing the extent of outward bulge of the sidewalls and/or end walls, the sidewalls and/or end walls still have substantial width.

Bulk bins made of corrugated material are typically manufactured from a single blank that is scored to delineate the sidewalls, end walls, diagonal corner panels, and bottom flaps. The blank is folded and secured at a manufacturer's joint by the manufacturer, and shipped to the user in a flattened condition. The user then sets the flattened bin on end and opens it up into an expanded tubular configuration. The bottom flaps are then folded inwardly and secured to hold the bin in its set-up condition. Self-locking bottom flaps have been developed to facilitate setting up the bin from its flattened condition to its fully open usable condition.

Octagonal bulk bins normally have eight bottom flaps, including two major flaps, two minor flaps, and four diagonal flaps. Conventional octagonal bulk bins with or without self-locking bottom flaps are cumbersome to assemble, and as a result users often seek alternative packaging. Further, the sequence of inward folding of the bottom flaps on a conventional octagonal bulk bin frequently results in creating extra pinch points in the bottom of the bin, e.g., by the diagonal flaps extending into the interior of the box bottom, which can damage the bag and cause it to rupture, thus contaminating the stored product.

It would be desirable to have a bulk bin that has all the advantages of an octagonal bulk bin, but that is free of the problems associated with conventional bulk bins, and particularly to have an octagonal bulk bin with bottom flaps, especially self-locking bottom flaps, that is relatively easy to erect into its operative position, is constructed to avoid the formation of weak points where tearing of the vertical fold can initiate and to avoid the formation of pinch points in the bottom.

SUMMARY OF THE INVENTION

The present invention comprises a bulk bin with self-locking bottom flaps constructed so that the bin is relatively easy to erect, and which avoids the formation of weak points where tearing of the vertical fold can initiate, and avoids the formation of pinch points in the bottom.

More particularly, the present invention comprises an octagonal bulk bin having self-locking bottom flaps with gusset panels or web panels connected between adjacent edges of the diagonal flaps and the respective adjacent major and minor bottom flaps, whereby the user has to fold only four bottom flaps inwardly, in contrast to the requirement to fold eight bottom flaps inwardly on conventional octagonal bins, and wherein the cuts or slits separating the bottom flaps from one another terminate in spaced relationship to the vertical folds, thereby eliminating the weak points where tearing of the vertical folds can initiate. The construction and sequence of folding of the bottom flaps also avoids the formation of pinch points.

Notches cut in the ends of the minor bottom flaps form a pair of locking tabs on each minor bottom flap, and angled slots cut in the major bottom flaps adjacent their outer edge form openings for receiving the locking tabs. The two major bottom flaps are first folded inwardly to square up the bin, followed by inward folding of the minor bottom flaps. Since the diagonal flaps are connected by gussets to adjacent edges of the major and minor bottom flaps, inward folding of the major flaps initiates inward movement of the minor flaps and diagonal flaps, and subsequent inward folding of the minor bottom flaps into their operative inwardly folded position also causes the diagonal flaps to fold inwardly, with the diagonal flaps essentially sandwiched between the major and minor flaps. By pressing the inwardly folded minor flaps downwardly against the previously inwardly folded major flaps, the locking tabs on the minor bottom flaps engage in the slots in the major bottom flaps to lock the bottom flaps in position and thus hold the bin in its setup condition.

Further, in a preferred embodiment of the present invention, the diagonal corner panels have the same or substantially the same width as the end walls, thus reducing the width of the sidewalls and end walls in a bin having a comparable capacity, and thereby reducing outward bulge of the sidewalls and/or end walls.

The bulk bin of the invention can be of single wall, double wall or triple wall construction, with or without sesame tape or strap reinforcing, and stretch wrap can be easily applied.

The gusset panels not only serve to facilitate setup of the bin and to space the ends of the flap slits from the bottom ends of the vertical folds, but also close the corners of the bin bottom.

The bulk bin of the invention can be used with a conventional wooden pallet, or a slip sheet, or can be set directly on a floor surface. Further, applicant has developed a plastic pallet tray for use with octagonal bulk bins, and especially when this pallet tray is used with the bulk bin of the invention it is contemplated that the bins can be stacked on top of one another, something that cannot be done with conventional octagonal bulk bins. Moreover, the plastic pallet tray serves as a jig to facilitate setup of the octagonal bulk bin, and prevents contact between the top of the bin and a floor surface, thereby reducing or eliminating contamination issues. The pallet tray is lightweight and nestable for economy in storage and shipping, is reusable, and has two-way accessibility for a hand jack and four-way accessibility for a fork lift. Although shown and described herein as used with the octagonal bulk bin of the invention, it should be understood that the plastic pallet tray has equal utility with conventional octagonal bulk bins, and with appropriate modification can be used with four-sided bins.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF PREFERRED EMBODIMENTS

Figure 1:
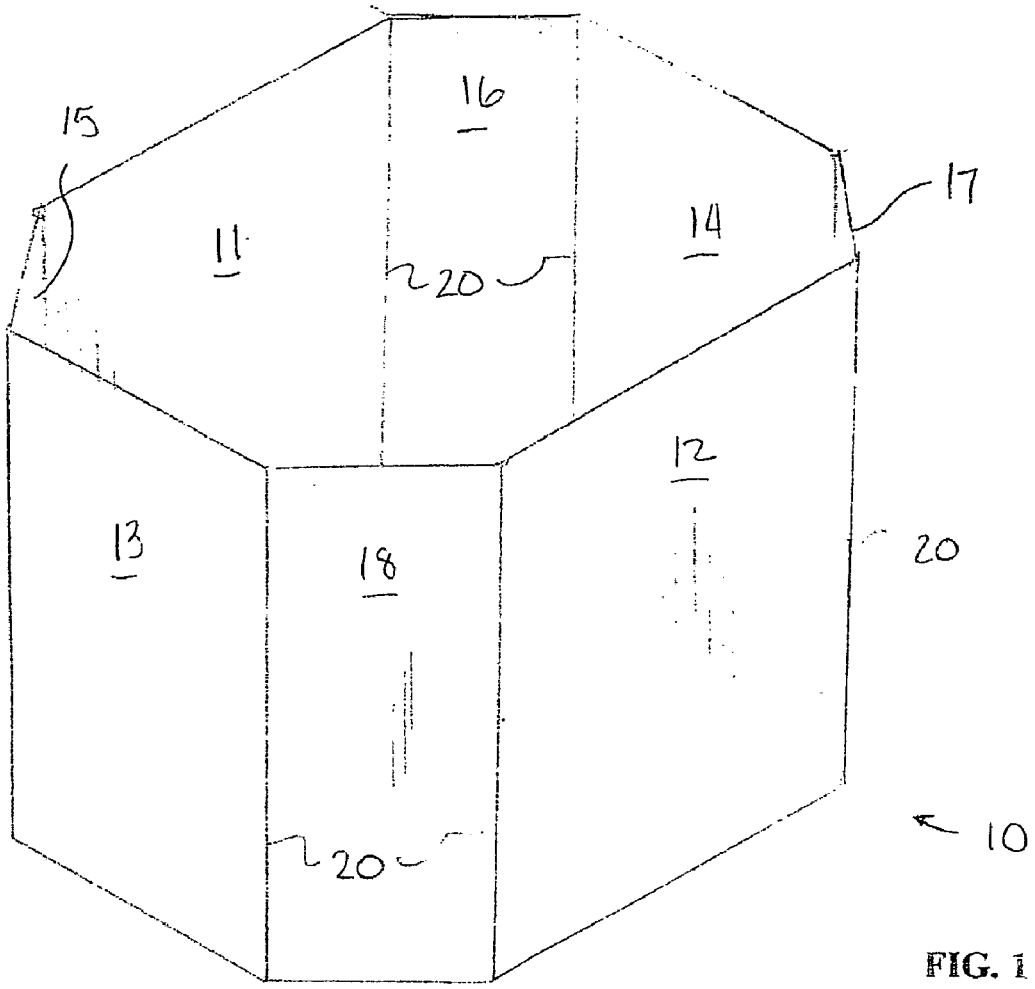
FIG. 1 is a top perspective view of one embodiment of an octagonal bulk bin according to the invention, wherein the diagonal corner panels have less width than the end wall panels.
Figure 2:
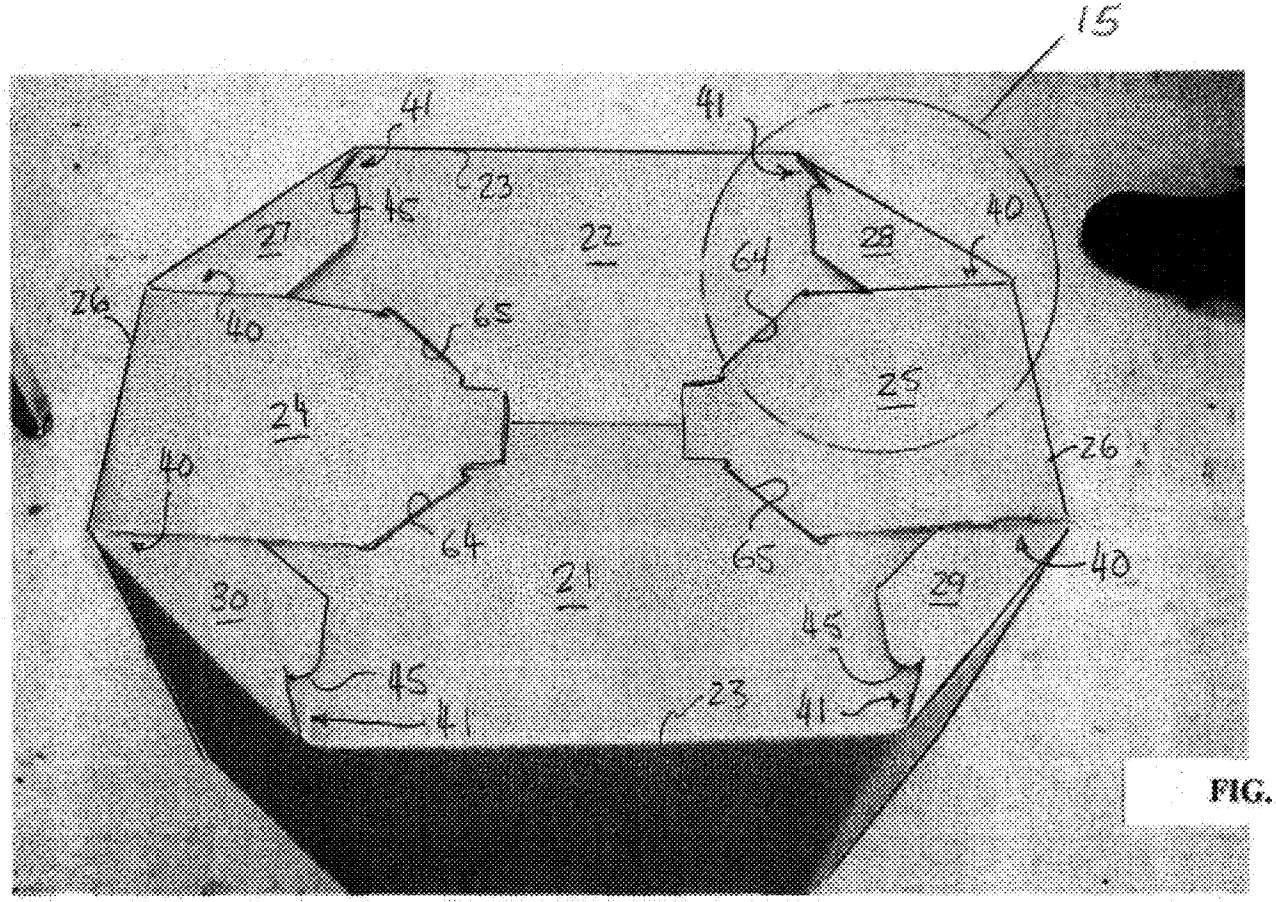
FIG. 2 is a bottom perspective view of a preferred embodiment of the bin of the invention, wherein the end walls and corner panels have the same width.
Figure 3:
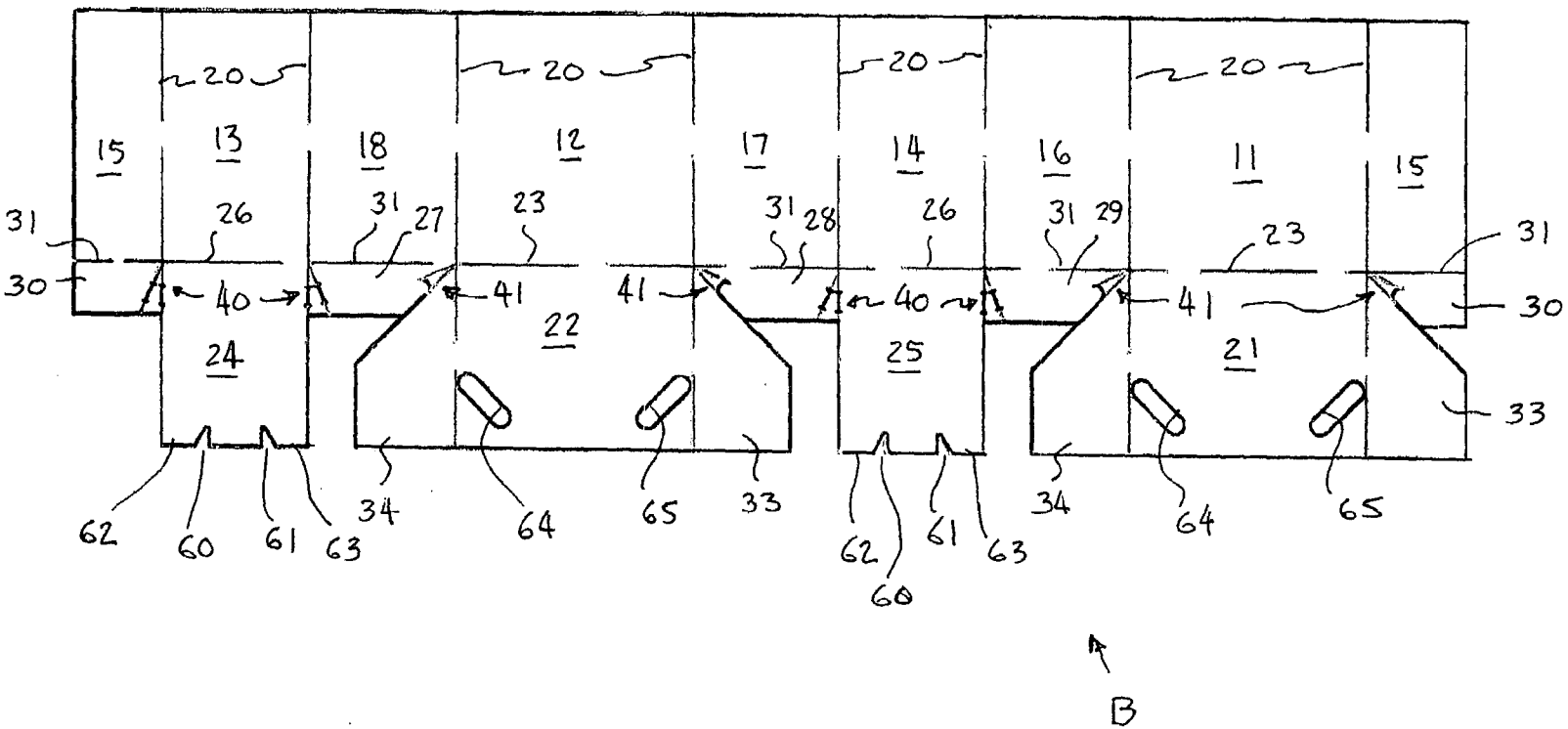
FIG. 3 is a plan view of a blank for making a bin according to the invention, wherein the corner panels have the same width as the end wall panels, for forming the preferred embodiment as shown in FIG. 2.

An octagonal bin in accordance with the invention is indicated generally at 10 in the drawings, and with particular reference to FIGS. 1, 2 and 3, comprises opposite parallel sidewalls 11 and 12, opposite parallel end walls 13 and 14, and diagonal corner panels 15, 16, 17 and 18 interposed between respective side and end walls. The side and end walls and the diagonal corner panels are joined along vertical folds 20. Major bottom flaps 21 and 22 are foldably joined to bottom edges of the respective sidewalls along horizontal folds 23, minor bottom flaps 24 and 25 are foldably joined to bottom edges of respective end walls along horizontal fold lines 26, and diagonal bottom flaps 27, 28, 29 and 30 are joined to respective diagonal corner panels along horizontal folds 31. The major and minor bottom flaps are equally long between their respective folds and free edges, but the major bottom flaps are much wider than the minor bottom flaps, having trapezoidally shaped wings 33 and 34 on opposite side edges thereof. The diagonal bottom flaps are much shorter than the major and minor bottom flaps, having a length between their respective folds and free edges that, in the particular embodiment shown, is only about ⅓ the length of the major and minor flaps.

It should be noted that as depicted in FIG. 1 the end walls are of less width than the sidewalls, and the diagonal corner panels are of less width than the end walls, but as depicted in the preferred embodiment shown in the remaining figures the diagonal corner panels have the same width as the end walls. The present invention is equally applicable to either form.

In either form the minor bottom flaps are connected to the diagonal bottom flaps at their respective adjacent side edges by first gusset panels or webs 40, and the major bottom flaps are connected to the respective opposite side edges of the diagonal bottom flaps by second gusset panels or webs 41, whereby the slits or cuts 42 separating the major bottom flaps from adjacent diagonal bottom flaps do not extend to the horizontal folds joining these flaps to the respective sidewalls and diagonal panels. Further, the cuts 42 delimit the angled side edges 43 and 44 of the wings 33 and 34 and terminate in J- or hook-shapes 45 pointing away from both the horizontal and vertical folds, thereby redirecting stress away from the lower end of the vertical folds to avoid initiation of a tear in the vertical fold.

Figure 4:
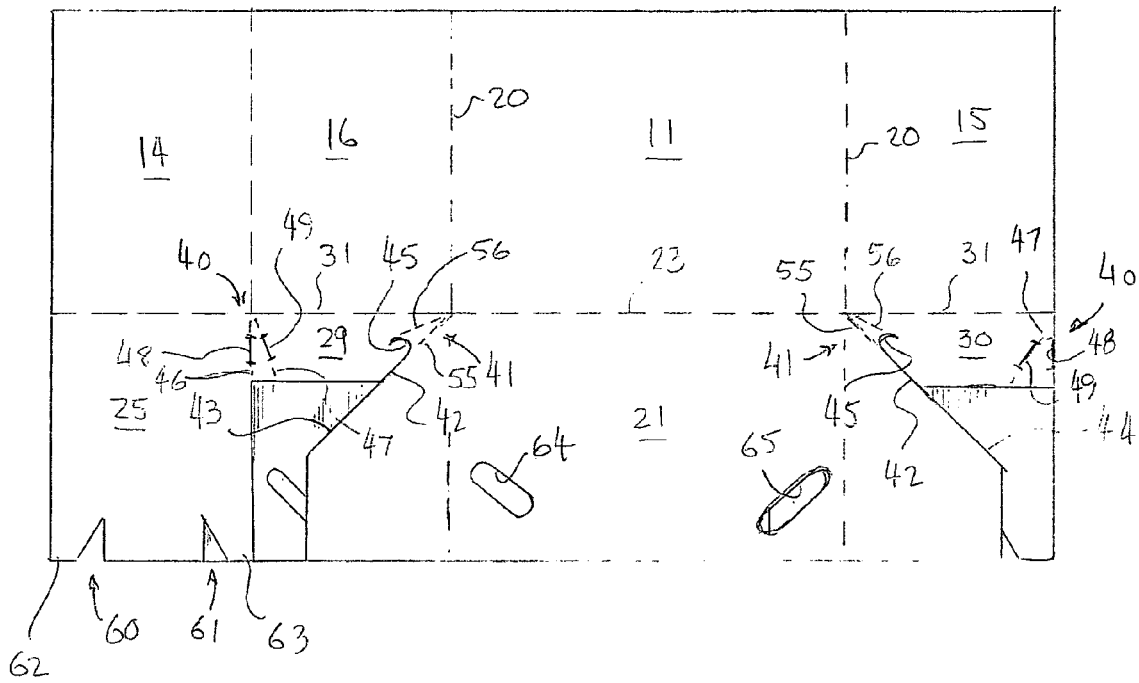
FIG. 4 is a plan view of the blank of FIG. 3, folded in half into a flattened condition for shipment to a user.
Figure 5:
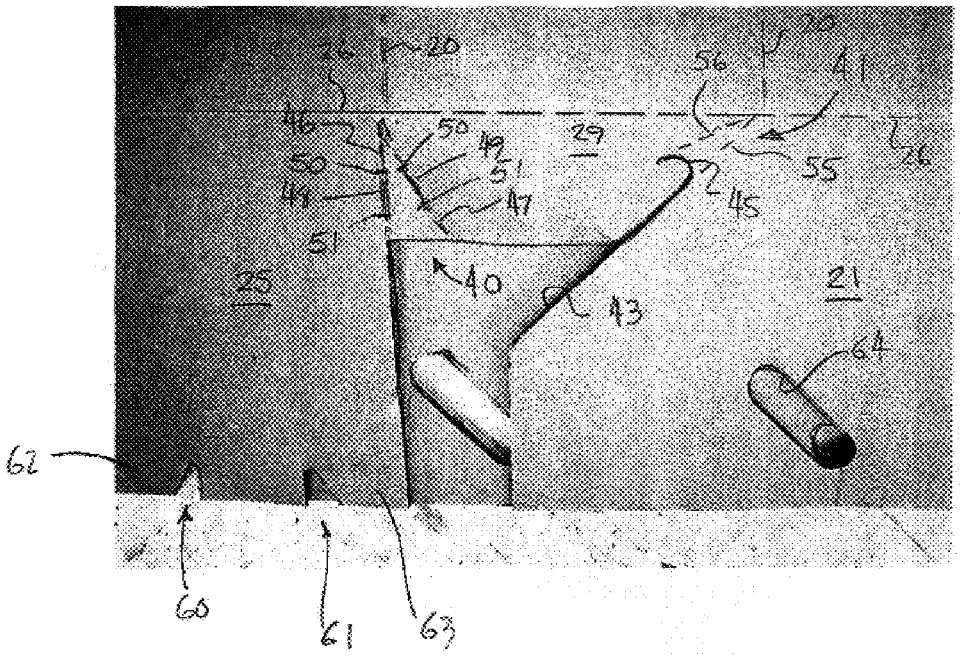
FIG. 5 is an enlarged fragmentary plan view of a portion of the folded flat blank of FIG. 4, showing details of one of the gusset panels.
Figure 7:
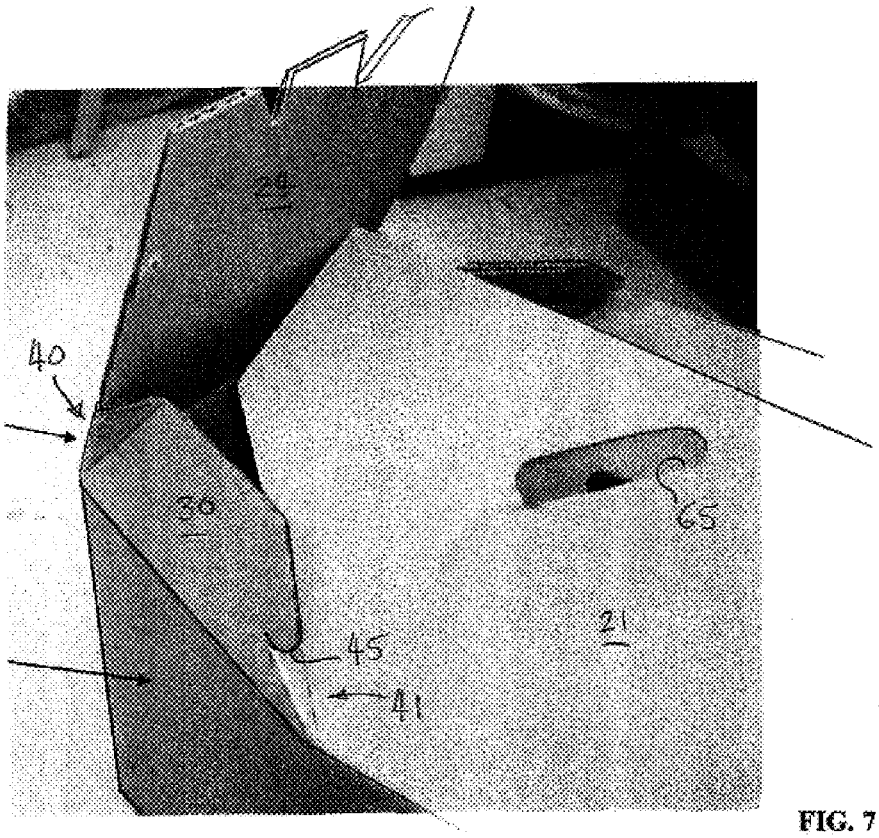
FIG. 7 is an enlarged fragmentary perspective view of a portion of the bottom of the bin of FIG. 6, showing a further stage of the bin being set up, wherein the major bottom flaps are folded inwardly.
Figure 8:
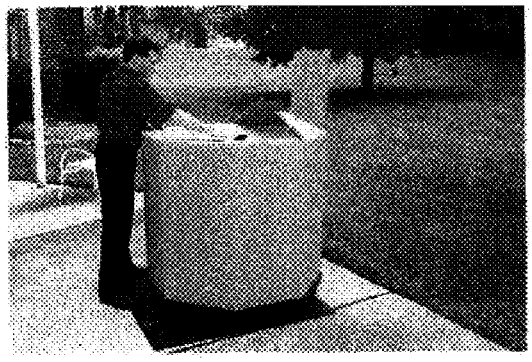
FIG. 8 is a bottom perspective view of the bin of FIG. 7, with the bin supported in the plastic pallet, and depicting one of the minor bottom flaps being folded inwardly after both major bottom flaps have been inwardly folded.
Figure 9:
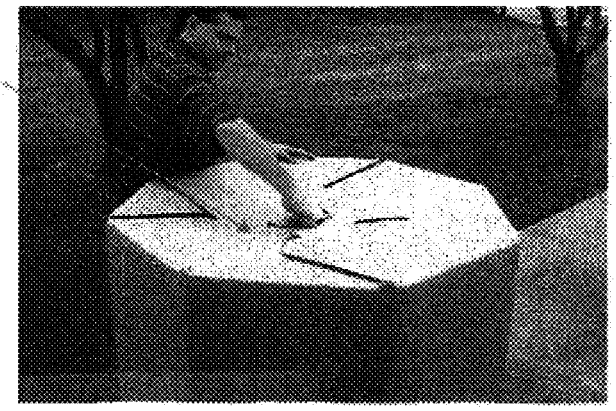
FIG. 9 is a bottom perspective view of the bin of FIG. 8, showing the other minor bottom flap being folded inwardly to its operative position, with the flaps shown interlocked.
Figure 10:
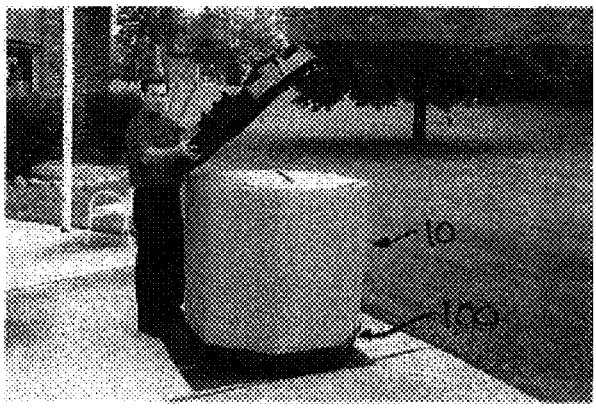
FIG. 10 shows the bin after all the bottom flaps have been inwardly folded and interlocked, and depicting how a second plastic pallet according to the invention can be placed over the fully folded and interlocked bottom of the bin.
Figure 11:
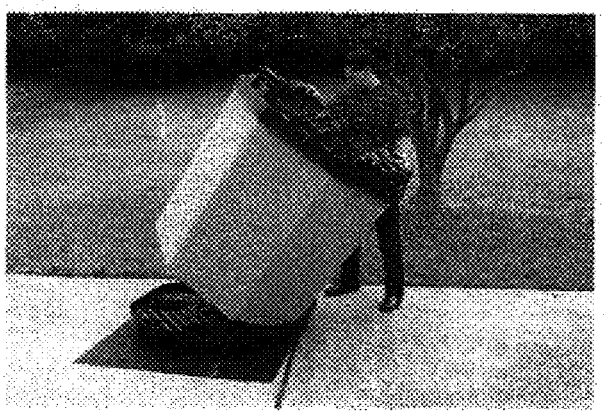
FIGS. 11 and 12 show the inverted bin of FIG. 10 being tilted out of the plastic pallet previously used to protect the open top end of the bin.
Figure 12:
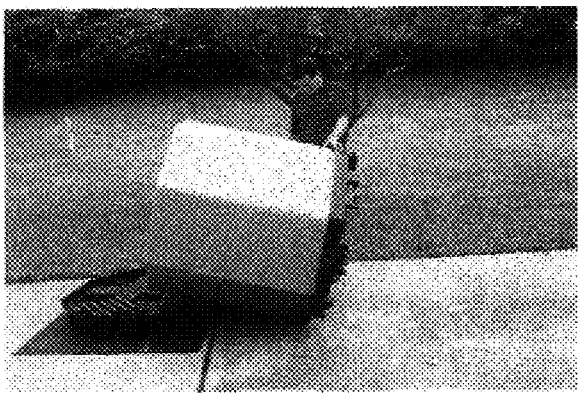
Figure 13:
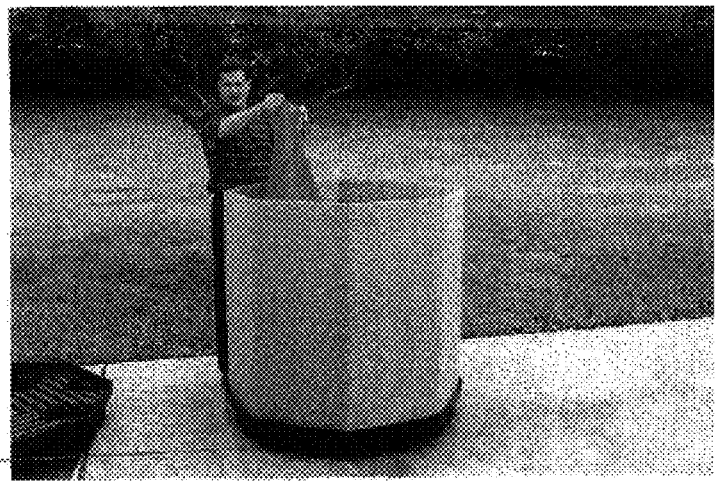
FIG. 13 shows the bin of FIGS. 11 and 12 in an upright position, resting on the pallet previously applied to the bottom end of the bin in FIG. 10, and depicting a plastic liner bag being inserted in the bin to help contain highly flowable materials when such materials are to be placed in the bin.
Figure 14:
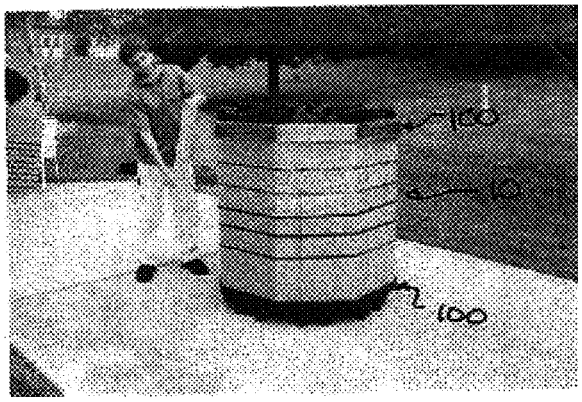
FIG. 14 shows a fully assembled bin, with reinforcing tape or straps applied and with plastic shrink wrap being applied.
Figure 15:
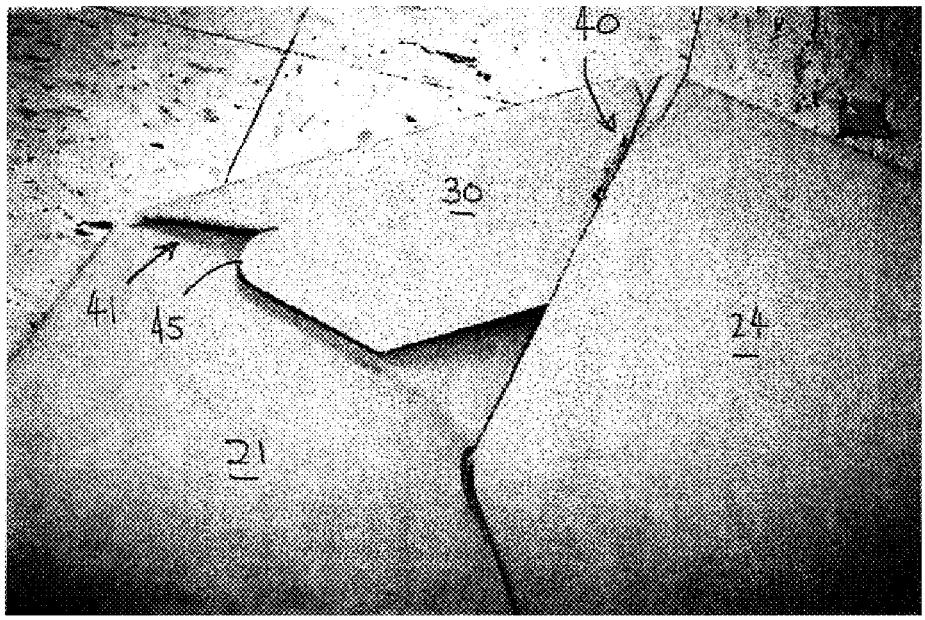
FIG. 15 is an enlarged fragmentary perspective view of the circled portion in FIG. 2, showing all the flaps folded inwardly to their operative locked position.

The gusset panels or webs 40 and 41 are seen best in FIGS. 4, 5 and 7. The first web 40 is formed by a first fold score 46 extending substantially collinear with the side edge of the associated minor bottom flap, and a second fold score 47 extending to a free outer edge of a respective diagonal bottom flap and at about a 300 angle relative to the first fold, with the first and second folds converging adjacent the closest intersection of the vertical and horizontal folds 20 and 26, respectively. Relief cuts 48 and 49 are made in each of the fold scores 46 and 47, extending over approximately one-third of a mid-portion of the length of the respective fold scores, and terminating at their ends in short transverse cuts 50 and 51 to prevent propagation of the cuts 48 and 49.

The second gusset panel or web 41 is defined by a first fold score 55 substantially collinear with the angled side edge 43 and extending from the base of the hook-shaped cut 45 to adjacent the closest intersection of a vertical and horizontal fold 20 and 26, respectively, and a second fold score 56 oriented at about a 300 angle relative to the first fold score and extending from the nose of the hook 45 to converge with the first fold score adjacent said closest intersection.

With regard to the gusset panels 40 and 41 and cuts 42 and 45, it should be noted that the shape of cut 45 need not be limited to a J-shape but can have any shape that redirects stress away from the end of cut 42 and avoids initiation of tearing along one of the gusset panel fold scores 55, 56 or along one of the vertical folds 20. For example, the cut could be shaped as a modified Greek letter psi, or an inverted modified Greek letter psi, or a T, L, U, V, etc as described in applicant's copending prior U.S. application Ser. No. 10/316,966, filed Dec. 11, 2002. Moreover, the point where the gusset panel fold scores 46, 47 or 55, 56 intersect can be located at the horizontal fold score 23, 26 or 31 or spaced a short distance therefrom.

A self-locking structure is defined by a pair of triangularly shaped notches 60 and 61 in the free edge of each of the minor bottom flaps, defining a pair of locking tabs 62 and 63 on the corners of the minor bottom flaps, and by a pair of angled slots 64 and 65 formed in the major bottom flaps near their free edge in a position to receive the locking tabs when the major and minor bottom flaps are folded inwardly over the bottom of the bin.

Figure 6:
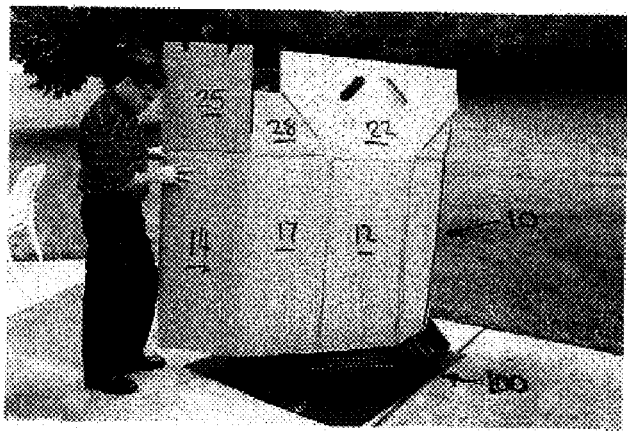
FIG. 6 is an enlarged perspective view of a bin according to the invention, shown in an inverted position and partially expanded during an initial stage of set up, with what would normally be the open top end of the bin being positioned on a plastic pallet according to the invention to aid in squaring up the bin and to prevent contact between the top end of the bin and the ground or floor, thus protecting the top end from contamination.

To erect the bin, it is placed in an inverted position with its bottom end up as seen in FIG. 6. If desired, to aid in squaring up the bin and to prevent contamination of the top end of the bin, the inverted bin may be placed on a plastic pallet 100. The major bottom flaps 21 and 22 are first folded inwardly as seen in FIG. 7, followed by inward folding of the minor bottom flaps 24 and 25. The minor flaps are then pressed downwardly against the major flaps, causing the major flaps to move downwardly slightly into the box to bring the locking tabs 62 and 63 into aligned registry with the slots 64 and 65. When downward pressure is released, the flaps spring back upwardly, with the tabs extending into the slots to interlock the flaps together in a generally planar position closing the bottom of the bin, as seen in FIG. 2. It will be noted that the locked minor bottom flaps also capture the diagonal bottom flaps to hold them in their inwardly folded position.

The bin 10 is made from a single unitary blank B, as shown in FIG. 3. The blank comprises a generally rectangularly shaped piece of corrugated material of suitable weight, e.g., single wall, double wall, or triple wall, having a plurality of first, parallel, spaced apart fold scores 20 delimiting sidewall panels 11 and 12, end wall panels 13 and 14, and diagonal corner panels 15, 16, 17 and 18. Second fold scores 23, 26 and 31, extending perpendicular to the first fold scores 20, define, respectively, bottom edges of the sidewall panels 11 and 12, end wall panels 13 and 14, and diagonal corner panels 15, 16, 17 and 18. A plurality of bottom-forming flap panels 21, 22, 24, 25 and 27-30 are joined along respective fold scores 23, 26 and 31 to the bottom edges of respective wall panels. Panels 21 and 22 form the major bottom flaps, panels 24 and 25 form the minor bottom flaps, and panels 27-30 form the diagonal bottom flaps in a bin erected from the blank. Generally trapezoidally shaped side extensions or wings 33 and 34 are foldably joined to opposite side edges of the major bottom flap panels along the fold scores 20. The diagonal bottom flap forming panels 27-30 are foldably joined to respective adjacent side edges of adjoining major and minor bottom flap forming panels by first and second gussets 40 and 41.

The major bottom flap forming panels 21 and 22 are separated from adjoining diagonal flap forming panels by cuts 42 extending at about a 45° angle from a side edge of the respective panel to a point spaced a substantial distance from a respective fold score 23 or 31. The cuts 42 define angled side edges 43 and 44 of the wings 33 and 34 and terminate in J- or hook-shapes 45 pointing away from the fold scores 23, 26 and 31. The second gussets 41 interconnect the major bottom forming flap panels and adjacent diagonal flap forming panels in the area between the J-shaped cuts 45 and the fold scores 23, 26 and 31.

The first gusset 40 comprises a triangular web delimited by a pair of fold scores 46 and 47 diverging at an angle of about 30° and extending from a point near but spaced from a respective fold score 23, 26 and 31 and its juncture with an adjacent fold score 20 to the free outer edge of a respective diagonal flap panel. Fold promoting cuts 48 and 49 are made along a short portion of the length of the fold scores 46 and 47, and short transverse cuts are made across the ends of the cuts 48 and 49 to prevent propagation of the cuts 48 and 49. The fold scores 46 are in general coaxial alignment with a respective adjacent fold score 20 and a side edge of a respective minor bottom flap panel.

The second gusset 41 comprises a triangular web delimited by a pair of fold scores 46 and 47 diverging at an angle of about 30° and extending from a point near but spaced from a respective fold score 23, 26 and 31 and its juncture with an adjacent fold score 20 to a respective J-shaped cut 45.

A pair of generally V-shaped notches 60 and 61 are formed in the free outer edges of each minor bottom flap panel 24 and 25, defining a pair of locking tabs 62 and 63 on the outer corners of the minor bottom flap panels.

Angled slots 64 and 65 are formed in an outer side edge portion of each major bottom flap panel 21 and 22.

The plastic pallet tray 100, when used with a bin, including the octagonal bin of the invention, facilitates set up of the bin, protects the top end of the bin from contamination, and also assists in resisting outward bulge of the sidewalls due to the outward pressure of the material stored therein. Moreover, it is contemplated that use of the pallet tray will enable the bins to be stacked on top of one another.

Figure 16:
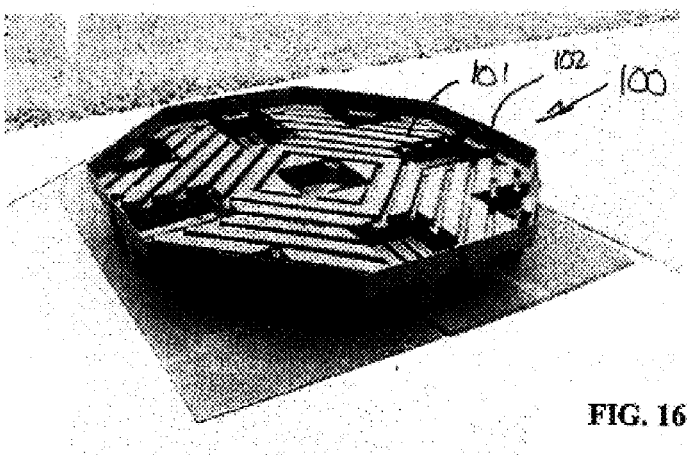
FIG. 16 is a top perspective view of the plastic pallet tray that can be used with the bin of the invention.
Figure 1:
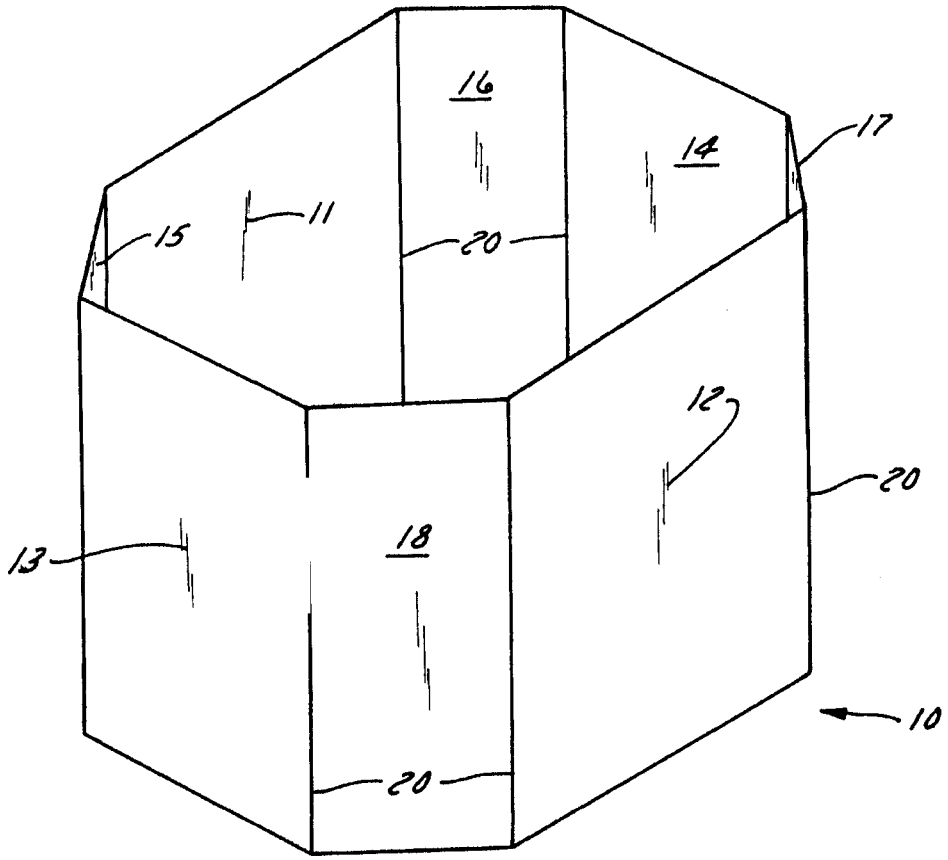
Figure 2:
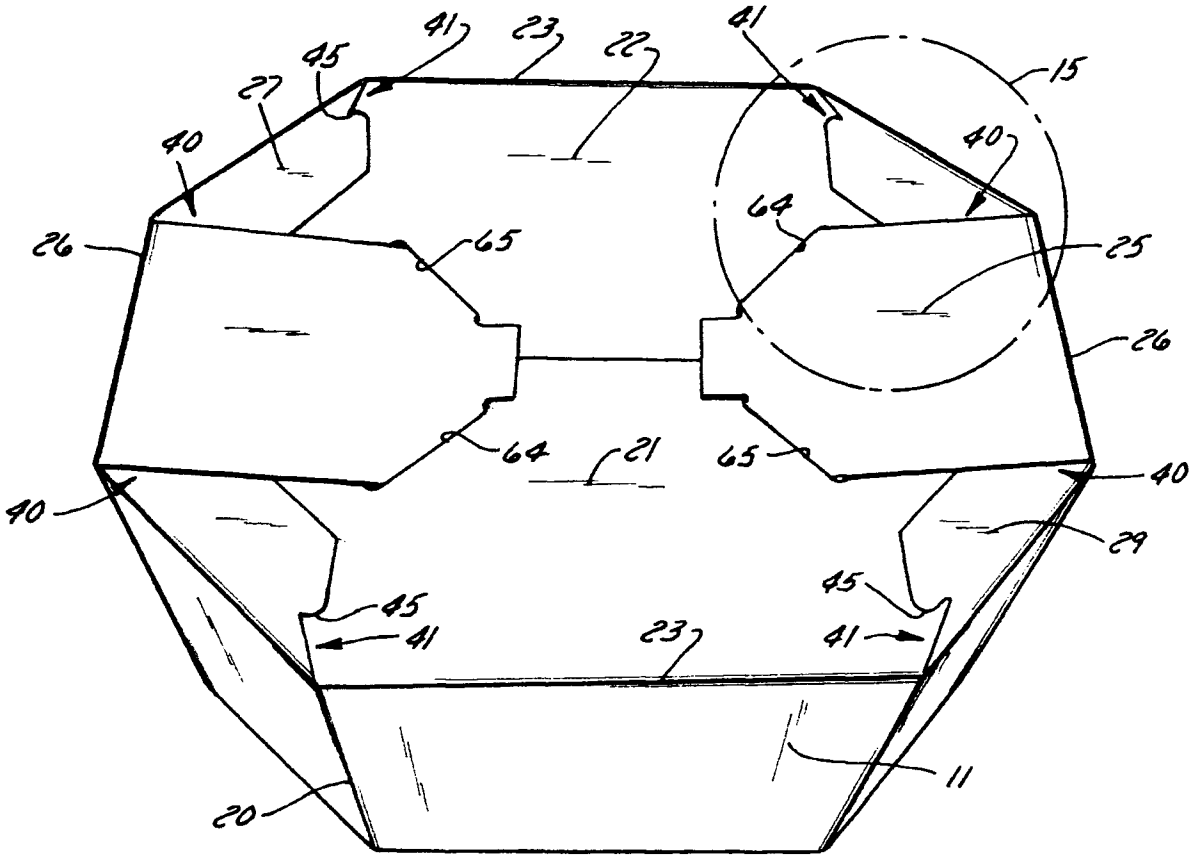
Figure 3:
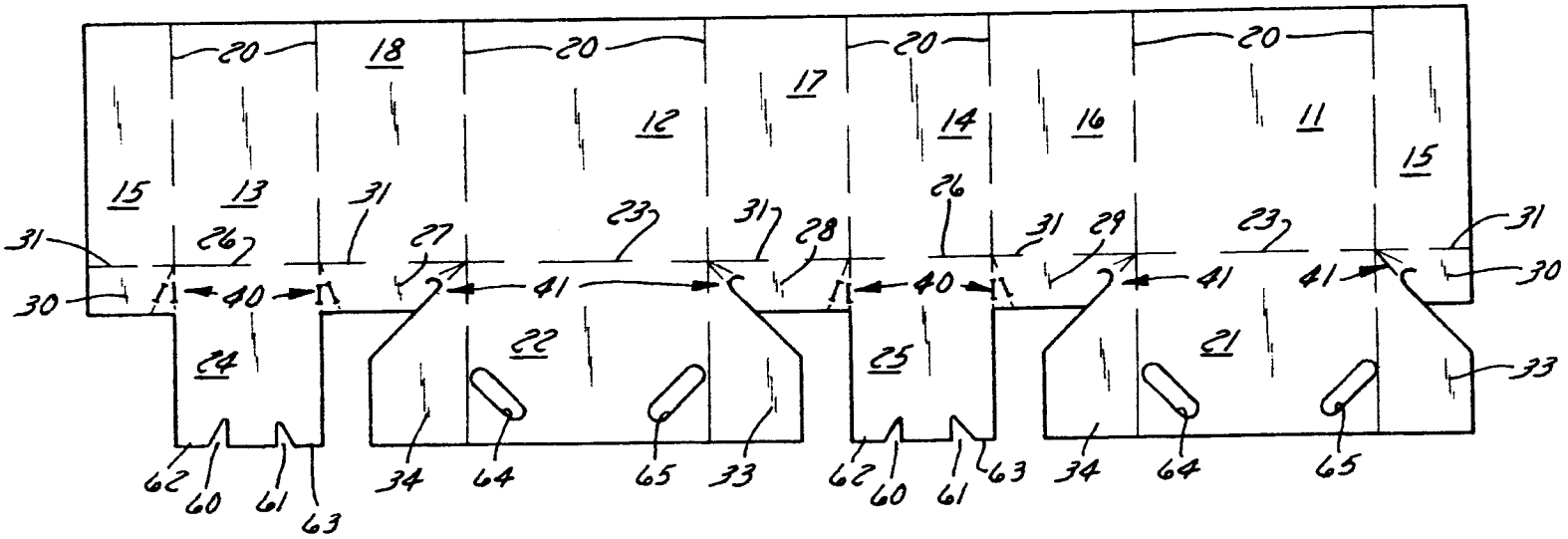
Figure 4:
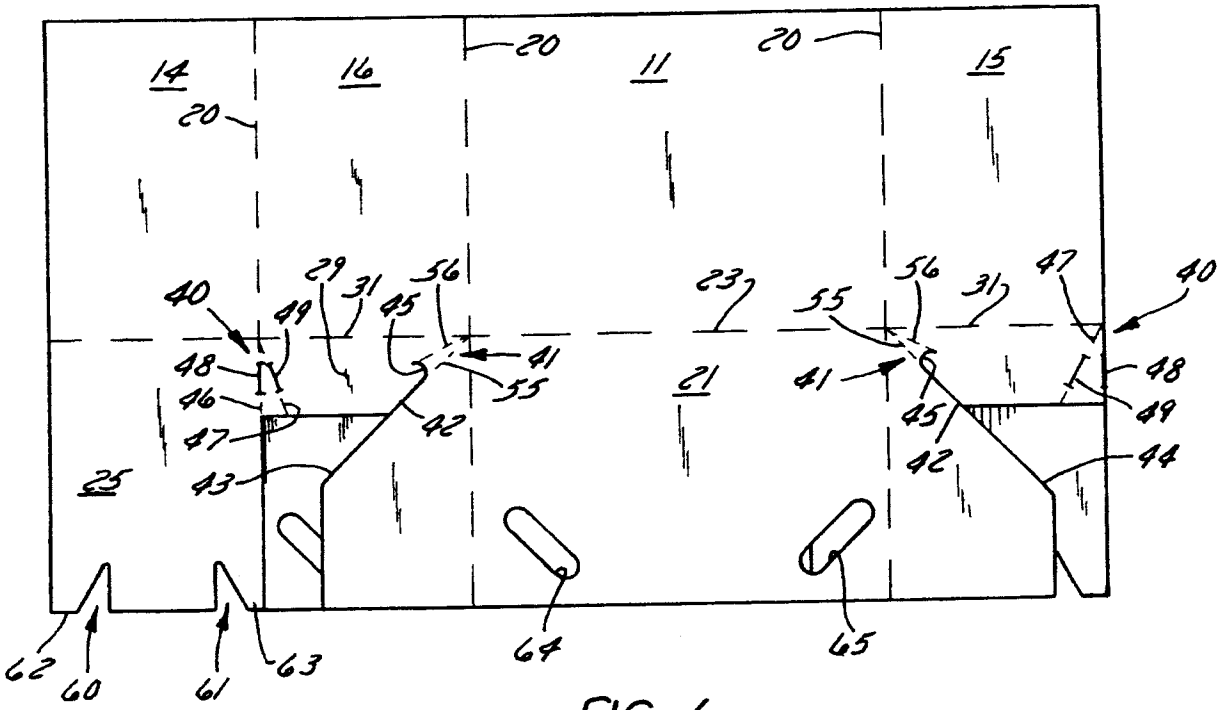
Figure 5:
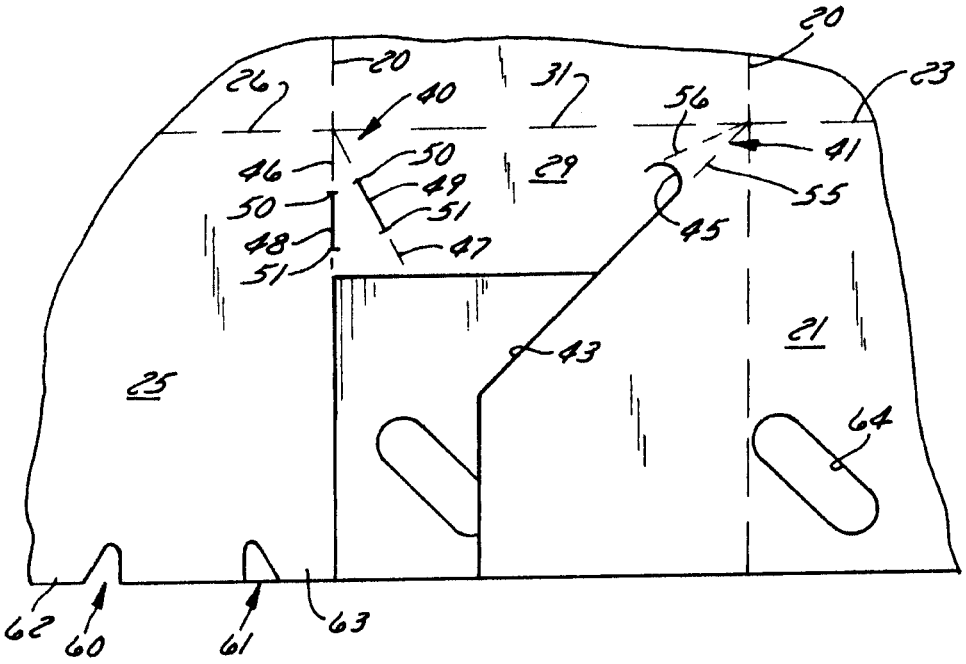
Figure 6:
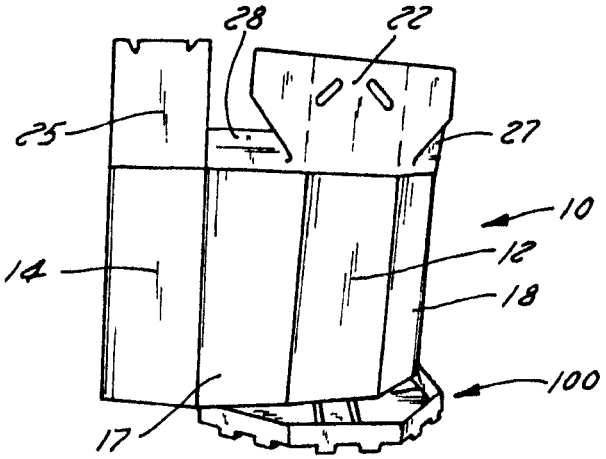
Figure 7:
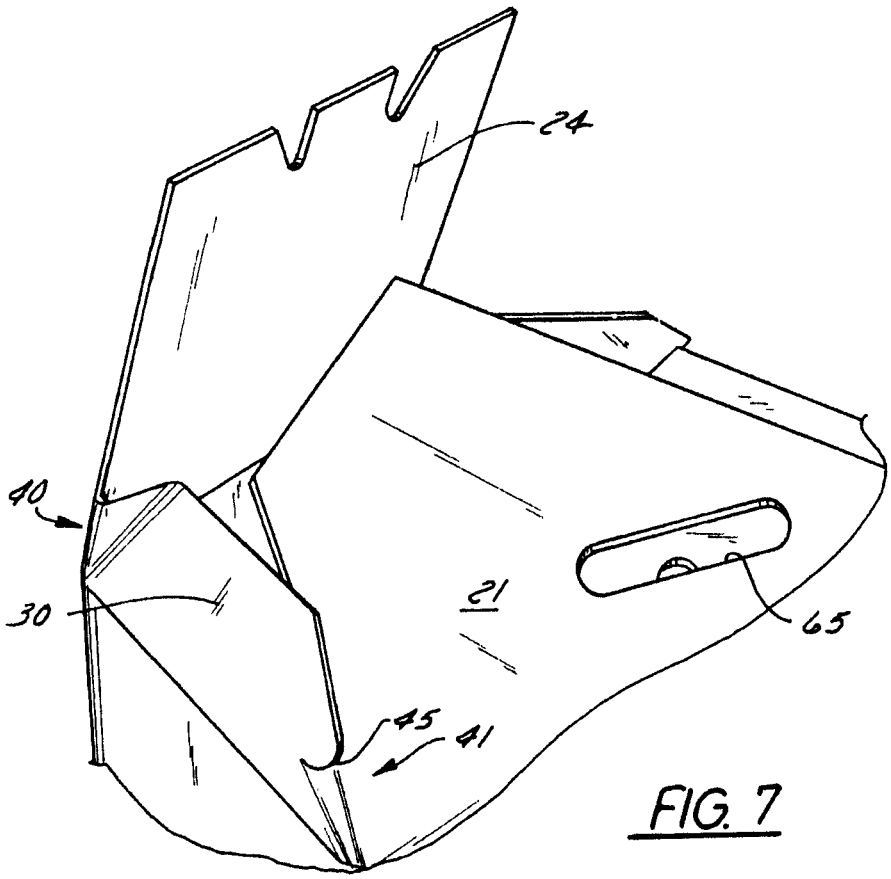
Figure 8:
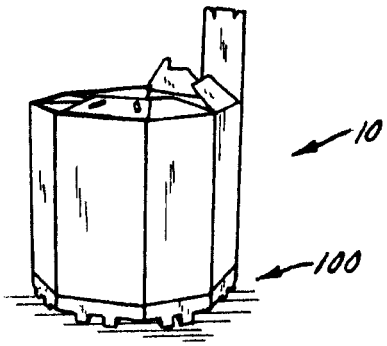
Figure 9:
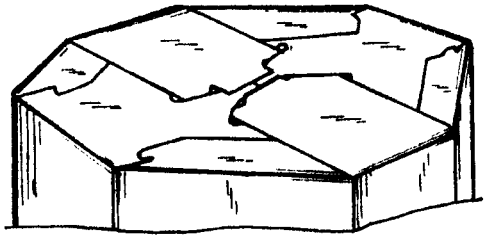
Figure 10:
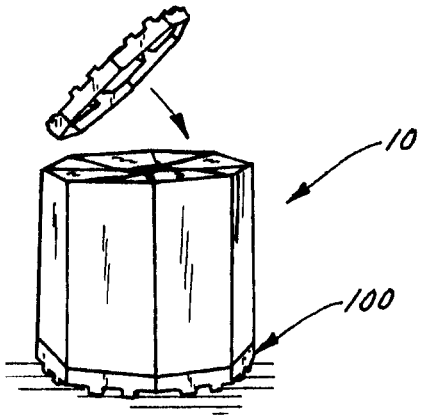
Figure 11:
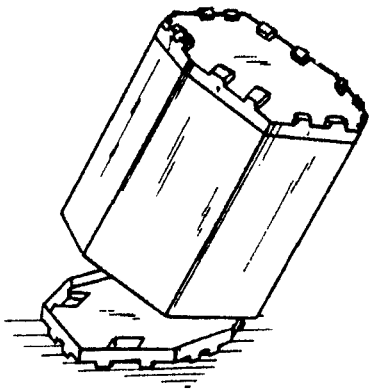
Figure 12:
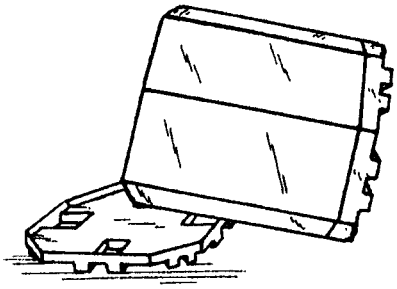
Figure 13:
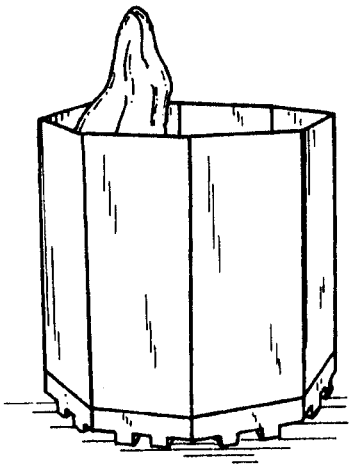
Figure 14:
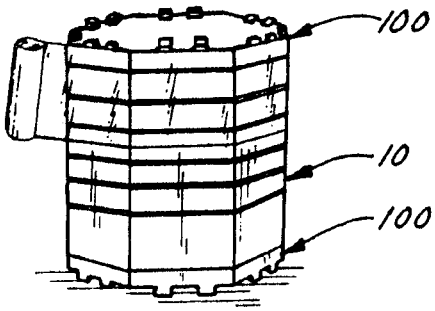
Figure 15:
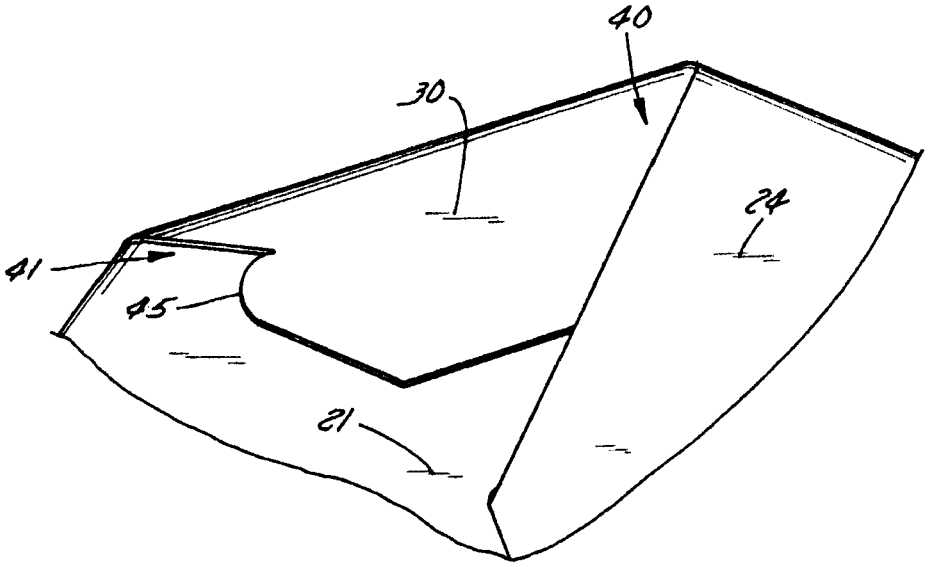
Figure 16:
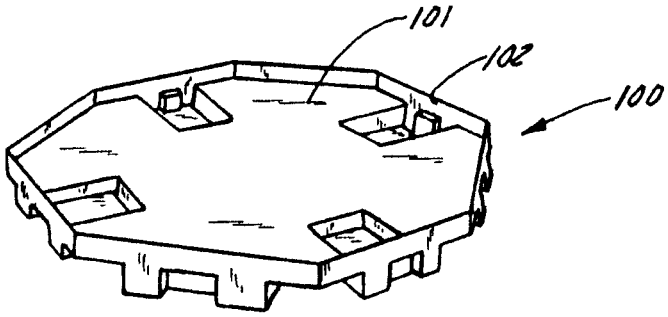

As seen best in FIG. 16, the pallet tray 100 comprises a deck 101 with an upstanding lip or flange 102 around its periphery, sized and shaped to closely receive the bottom end of the octagonal bin. Thus, the pallet tray is not only capable of functioning as a jig to aid in setting up the bin, but it also reinforces the bottom end of the tray to help it resist outward pressure from the contents of the bin. The pallet tray further includes legs or supports 103 projecting downwardly from the bottom surface of the deck, defining spaces therebetween for receipt of a hand jack or the tines of a fork lift. The legs are hollow, as seen best in FIG. 6, and are shaped so that the legs of one pallet tray can nest or telescope into the legs of a subjacent pallet tray for nestable stacking of the pallet trays.

What is claimed is:

1. An octagonal bulk bin comprising:

a pair of opposite sidewalls, a pair of opposite end walls, and opposed pairs of diagonal corner panels interposed between adjacent said sidewalls and end walls, wherein the sidewalls, end walls and diagonal corner panels are joined to one another along vertical folds;

major bottom flaps foldably joined to bottom edges of the sidewalls along horizontal folds;

minor bottom flaps foldably joined to bottom edges of the end walls along horizontal folds;

diagonal bottom flaps foldably joined to bottom edges of the diagonal panels along horizontal folds;

cuts separating said major bottom flaps from respective adjacent said diagonal bottom flaps, said cuts terminating in spaced relation to said horizontal folds to prevent initiation of tearing of said vertical folds;

first gusset panels interconnecting opposite side edges of each said minor bottom flap with adjacent side edges of respective adjacent said diagonal bottom flaps; and second gusset panels interconnecting opposite side edges of each said major bottom flap with adjacent side edges of respective adjacent said diagonal bottom flaps, said cuts separating said major bottom flaps from respective adjacent said diagonal bottom flaps terminating at respective said second gusset panels.

2. An octagonal bulk bin as claimed in claim 1, wherein:

said cuts separating said major bottom flaps from respective adjacent said diagonal bottom flaps terminate in a J-shape that redirects stress away from said horizontal and vertical folds.

3. An octagonal bulk bin as claimed in claim 2, wherein:

said first and second gusset panels each comprise a triangular web delimited by a pair of fold scores diverging from a point near the juncture of the horizontal fold for the respective associated flaps and an adjacent vertical fold.

4. An octagonal bulk bin as claimed in claim 3, wherein:

one of said fold scores of said pair of diverging fold scores delimiting the web of each of said first gusset panels is collinear with an adjacent side edge of a respective said minor bottom flap and with an adjacent said vertical fold; and the other of said fold scores of said pair of diverging fold scores extends to a free outer edge of a respective said diagonal bottom flap.

5. An octagonal bulk bin as claimed in claim 3, wherein:

a fold-promoting cut is made in each of the diverging fold scores delimiting said web of each of said first gusset panels, said fold-promoting cut extending over only a portion of the length of said fold scores and terminating at opposite ends thereof spaced from opposite ends of said fold scores.

6. An octagonal bulk bin as claimed in claim 5, wherein:

a short transverse cut is made across said opposite ends of each fold-promoting cut to prevent propagation of said fold-promoting cuts.

7. An octagonal bulk bin as claimed in claim 3, wherein:

one of the diverging fold scores delimiting the web of each said second gusset panel is coaxially aligned with a respective cut separating a respective said major bottom flap from a respective adjacent said diagonal bottom flap, and the other of said diverging fold scores extends to a terminal end of said J shape.

8. An octagonal bulk bin as claimed in claim 1, wherein:

a pair of spaced apart V-shaped notches are formed in an outer free edge of each minor bottom flap, forming a pair of spaced apart locking tabs on opposite corners of said outer free edge of each minor bottom flap; and a pair of spaced apart open slots are formed adjacent an outer free edge of each said major bottom flap in a position to be in aligned registry with respective said locking tabs when the major and minor bottom flaps are folded inwardly to closed position across the bottom of said bin, said locking tabs extending into said slots to lock the major and minor bottom flaps in their inwardly folded position.

9. An octagonal bulk bin as claimed in claim 8, wherein:

second gusset panels interconnect opposite side edges of each said major bottom flap with adjacent side edges of respective adjacent said diagonal bottom flaps, said cuts separating said major bottom flaps from respective adjacent said diagonal bottom flaps terminating at respective said second gusset panels.

10. An octagonal bulk bin as claimed in claim 9, wherein:

said cuts separating said major bottom flaps from respective adjacent said diagonal bottom flaps terminate in a J-shape that redirects stress away from said horizontal and vertical folds.

11. An octagonal bulk bin as claimed in claim 10, wherein:

said first and second gusset panels each comprise a triangular web delimited by a pair of fold scores diverging from a point near the juncture of the horizontal fold for the respective associated flaps and an adjacent vertical fold.

12. An octagonal bulk bin as claimed in claim 11, wherein:

one of said fold scores of said pair of diverging fold scores delimiting the web of each of said first gusset panels is collinear with an adjacent side edge of a respective said minor bottom flap and with an adjacent vertical fold; and the other of said fold scores of said pair of diverging fold scores delineating the web of each of said first and second gusset panels extends to a free outer edge of a respective said diagonal miner bottom flap.

13. An octagonal bulk bin as claimed in claim 11, wherein:

a fold-promoting cut is made in each of the diverging fold scores delimiting said web of each of said first gusset panels, said fold-promoting cut extending over only a portion of the length of said fold scores and terminating at opposite ends thereof spaced from opposite ends of said fold scores.

14. An octagonal bulk bin as claimed in claim 13, wherein:

a short transverse cut is made across said opposite ends of each fold-promoting cut to prevent propagation of said fold-promoting cuts.

15. An octagonal bulk bin as claimed in claim 11, wherein:

one of the diverging fold scores delimiting the web of each said second gusset panel is collinear with a respective cut separating a respective said major bottom flap from a respective adjacent said diagonal bottom flap, and the other of said diverging fold scores extends to a terminal end of said J shape.

16. A blank for making an octagonal bulk bin, comprising:

a unitary piece of generally rectangularly shaped material having a plurality of first, parallel, spaced apart fold scores delimiting adjacent sidewall panels, end wall panels, and diagonal corner panels;

a second fold score extending perpendicular to the first fold scores and defining a bottom edge of the sidewall panels, end wall panels and diagonal corner panels;

major bottom-forming flap panels joined to the bottom edge of said sidewall panels along said second fold line;

minor bottom-forming flap panels joined to the bottom edge of said end wall panels along said second fold line;

diagonal bottom-forming flap panels joined to the bottom edge of said diagonal corner panels along said second fold line; cuts separating said major bottom-forming flap panels from respective adjacent said diagonal bottom-forming flap panels, said cuts terminating in spaced relation to said second fold score;

first gusset panels connected between adjacent side edges of the minor bottom-forming flap panels and the diagonal bottom-forming flap panels; and second gusset panels connected between adjacent side edges of the major bottom-forming flap panels and the diagonal bottom-forming flap panels said cuts separating said major bottom-forming flap panels from respective adjacent said diagonal bottom-forming flap panels terminating at respective said second gusset panels.

* * * * *

UNITED STATES PATENT AND TRADEMARK OFFICE

CERTIFICATE OF CORRECTION

PATENT NO. : 7,681,781 B2
APPLICATION NO. : 11/512865
DATED : March 23, 2010
INVENTOR(S) : Wisecarver It is certified that error appears in the above-identified patent and that said Letters Patent is hereby corrected as shown below:

Delete Title page, illustrating a figure(s), and substitute therefor, a new Title page illustrating a figure(s). (attached)

Delete drawing sheets 1-9, and substitute therefor drawing sheets 1-9. (attached).

Signed and Sealed this

Twenty-ninth Day of June, 2010

David J. Kappos

David J. Kappos
*Director of the United States Patent and Trademark Office*

(12) United States Patent
Wisecarver

(10) Patent No.: US 7,681,781 B2
(45) Date of Patent: Mar. 23, 2010

(54) OCTAGONAL BULK BIN WITH SELF-LOCKING GUSSET-FOLD BOTTOM FLAPS

(75) Inventor: Mark A. Wisecarver, Morristown, TN (US)

(73) Assignee: International Paper Company, Memphis, TN (US)

( * ) Notice: Subject to any disclaimer, the term of this patent is extended or adjusted under 35 U.S.C. 154(b) by 704 days.

(21) Appl. No.: 11/512,865

(22) Filed: Aug. 29, 2006

(65) Prior Publication Data

US 2007/0051783 A1 Mar. 8, 2007

Related U.S. Application Data

(60) Provisional application No. 60/712,236, filed on Aug. 29, 2005.

(51) Int. Cl.

| | |
|---|---|
| ***B65D 5/00*** | (2006.01) |
| ***B65D 5/10*** | (2006.01) |
| ***B65D 5/08*** | (2006.01) |
| ***B65D 5/24*** | (2006.01) |
| ***B65D 19/00*** | (2006.01) |

(52) U.S. Cl. ..... 229/109; 229/156; 229/157; 229/920; 229/930; 229/931; 229/184; 229/188; 229/185; 229/137; 206/386

(58) Field of Classification Search ..... 229/109, 229/156, 157, 920, 930, 931, 184, 188, 185, 229/137; 206/386

See application file for complete search history.

(56) References Cited

U.S. PATENT DOCUMENTS

| | | | | |
|---|---|---|---|---|
| 3,261,533 A | | 7/1966 | Repking | |
| 4,428,499 A | | 1/1984 | Nauheimer | |
| 4,480,748 A | * | 11/1984 | Wind | 206/386 |
| 4,702,408 A | | 10/1987 | Powlenko | |
| 5,139,196 A | * | 8/1992 | Fry et al. | 229/157 |
| 5,628,450 A | * | 5/1997 | Cromwell et al. | 229/109 |
| 5,752,648 A | | 5/1998 | Quaintance | |
| 5,816,483 A | * | 10/1998 | Gasper | 229/109 |
| 6,074,331 A | * | 6/2000 | Ruggiere et al. | 493/89 |
| 6,132,349 A | * | 10/2000 | Yokoyama | 493/86 |
| 6,371,363 B1 | | 4/2002 | Franklin et al. | |
| 6,588,651 B2 | | 7/2003 | Quaintance | |
| 6,783,058 B2 | | 8/2004 | Quaintance | |
| 2003/0116615 A1 | | 6/2003 | Hyatt et al. | |

FOREIGN PATENT DOCUMENTS

| | | |
|---|---|---|
| DE | 2818110 | 11/1978 |
| EP | 1544117 | 6/2005 |
| US | 4247021 | 1/1981 |

* cited by examiner

*Primary Examiner*—Gary E Elkins
*Assistant Examiner*—Latrice Byrd
(74) *Attorney, Agent, or Firm*—Thomas W. Barnes, III; Dennis Lambert

(57) ABSTRACT

An octagonal bulk bin has sidewalls, end walls and diagonal corner panels interposed between adjacent sidewalls and end walls. Bottom flaps are foldably joined to a bottom edge of the sidewalls, end walls, and diagonal corner panels, and gusset panels connect adjacent side edges of the bottom flaps, facilitating set up of the bulk bin and spacing flap cuts from the corners of the bin to minimize or eliminate initiation of tears in the vertical corners of the bin. A plastic pallet tray has an upstanding lip around its periphery, shaped and sized to closely receive the bottom end of the octagonal bin to reinforce the bottom end and facilitate handling of the bin.

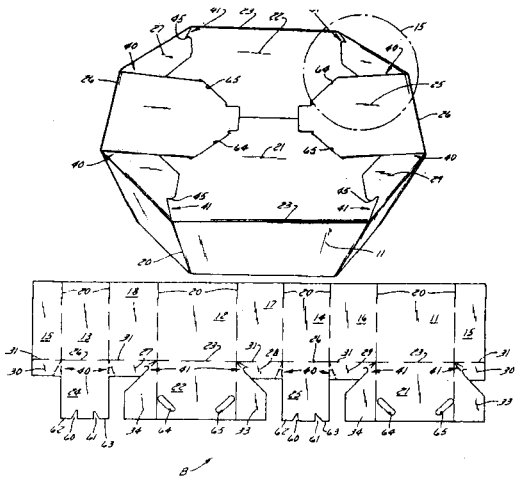

16 Claims, 9 Drawing Sheets